US008956269B1

(12) United States Patent
Skeete

(10) Patent No.: US 8,956,269 B1
(45) Date of Patent: Feb. 17, 2015

(54) MUSCLE GROUP ISOLATOR SYSTEM

(71) Applicant: Ricardo Denis Skeete, Brooklyn, NY (US)

(72) Inventor: Ricardo Denis Skeete, Brooklyn, NY (US)

( * ) Notice: Subject to any disclaimer, the term of this patent is extended or adjusted under 35 U.S.C. 154(b) by 258 days.

(21) Appl. No.: 13/683,556

(22) Filed: Nov. 21, 2012

(51) Int. Cl.
*A63B 23/00* (2006.01)
*A63B 23/04* (2006.01)

(52) U.S. Cl.
CPC ..... *A63B 23/04* (2013.01)
USPC ..... 482/139

(58) Field of Classification Search
USPC ..... 482/80, 112, 139; 297/68–91, 423.1, 297/423.38, 423.45, 463.1, 466, 423.12, 297/423.25, 423.4, DIG. 4
See application file for complete search history.

(56) References Cited

U.S. PATENT DOCUMENTS

| | | | | | |
|---|---|---|---|---|---|
| 7,908 | A * | 1/1851 | Scheitlin | 425/359 |
| 73,329 | A * | 1/1868 | Hess et al. | 254/114 |
| 741,414 | A * | 10/1903 | Ryan | 254/114 |
| 3,000,632 | A * | 9/1961 | Fuchs | 482/97 |
| 3,189,385 | A * | 6/1965 | Mommsen | 297/423.26 |
| 3,195,952 | A * | 7/1965 | Bache et al. | 297/374 |
| 3,473,844 | A * | 10/1969 | Zinnkann | 297/328 |
| 3,778,103 | A * | 12/1973 | Edwards | 297/331 |
| 4,502,730 | A * | 3/1985 | Kazaoka et al. | 297/366 |
| 4,506,925 | A * | 3/1985 | Crum | 297/69 |
| 4,629,251 | A * | 12/1986 | Tezuka | 297/362 |
| 4,822,038 | A * | 4/1989 | Maag | 482/97 |
| 4,961,473 | A * | 10/1990 | Jones | 180/65.1 |
| 5,088,789 | A * | 2/1992 | LaPointe et al. | 297/69 |
| 5,259,664 | A * | 11/1993 | Cottle | 297/423.26 |
| 5,733,233 | A * | 3/1998 | Webber | 482/137 |
| 6,019,711 | A * | 2/2000 | Koenig | 482/97 |
| 6,074,328 | A * | 6/2000 | Johnson | 482/97 |
| 6,450,581 | B1 * | 9/2002 | Koerlin | 297/423.26 |
| 6,578,915 | B2 * | 6/2003 | Jonas et al. | 297/284.11 |
| 7,357,765 | B1 * | 4/2008 | Watson et al. | 482/142 |
| 8,052,217 | B2 * | 11/2011 | Toso et al. | 297/423.12 |
| 2002/0193210 | A1 * | 12/2002 | Turner | 482/80 |
| 2007/0066452 | A1 * | 3/2007 | Marshall | 482/92 |
| 2007/0254787 | A1 * | 11/2007 | Matsubara et al. | 482/139 |
| 2008/0058177 | A1 * | 3/2008 | Webber et al. | 482/94 |
| 2009/0033129 | A1 * | 2/2009 | Marshall | 297/69 |
| 2010/0026069 | A1 * | 2/2010 | Bruck et al. | 297/344.1 |
| 2010/0164201 | A1 * | 7/2010 | Hochberg et al. | 280/304.1 |
| 2011/0095589 | A1 * | 4/2011 | Shao | 297/378.12 |
| 2012/0277069 | A1 * | 11/2012 | Hockridge et al. | 482/94 |
| 2013/0143722 | A1 * | 6/2013 | Thorpe | 482/91 |
| 2014/0001805 | A1 * | 1/2014 | Crofts | 297/354.1 |
| 2014/0038798 | A1 * | 2/2014 | Littell | 482/145 |

* cited by examiner

*Primary Examiner* — Loan H Thanh
*Assistant Examiner* — Andrew S Lo

(57) ABSTRACT

Laterally spaced side panels each have an interior surface, an exterior surface, and a slot. Slide plates each have an interior surface, an exterior surface, and a slot. The interior surface of each plate is slidable on the exterior surface of an associated one of the side panels. Levers each have a handle, actuator ends, and a central extent. Pivot pins couple the central extents of the levers to the panel. Each actuator end has a slot. A follower pin extends interiorly from a lower end of each slide plate and through an associated slot in an actuator end. A leg support roller is mounted in the plates for raising and lowering the plates in response to pivoting of the levers.

5 Claims, 3 Drawing Sheets

FIG. 1
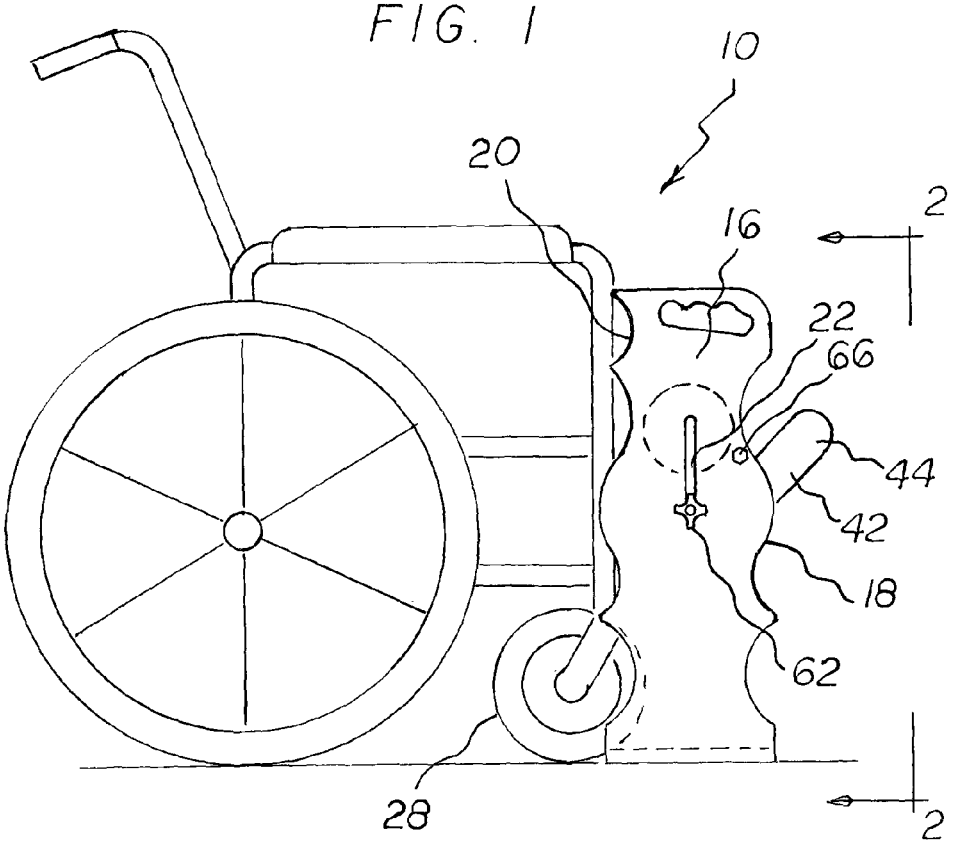
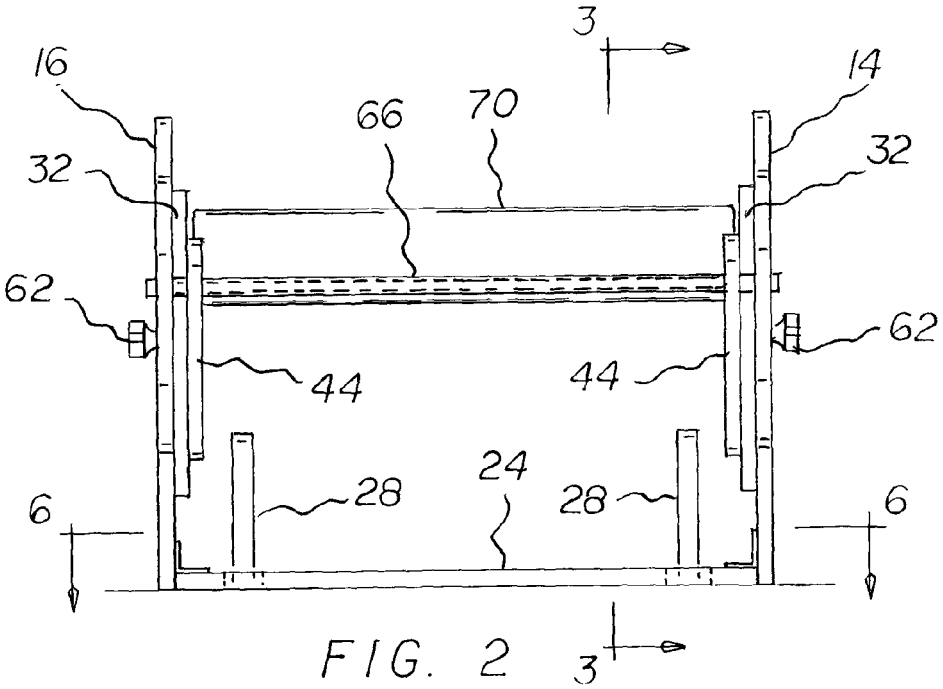
FIG. 2

MUSCLE GROUP ISOLATOR SYSTEM

BACKGROUND OF THE INVENTION

Field of the Invention

The present invention relates to a muscle group isolator system and more particularly pertains to facilitating the performance of therapeutic exercises by way of muscle isolation and prevention of associated joint movement and elimination of body compensation, the performance, isolation, prevention and elimination being done in a safe, convenient and economical manner.

SUMMARY OF THE INVENTION

In view of the disadvantages inherent in the known types of exercise systems of known designs and configurations now present in the prior art, the present invention provides an improved muscle group isolator system. As such, the general purpose of the present invention, which will be described subsequently in greater detail, is to provide a new and improved muscle group isolator system and method which has all the advantages of the prior art and none of the disadvantages.

To attain this, the present invention essentially comprises a muscle group isolator system. Laterally spaced side panels each have an interior surface, an exterior surface, and a slot. Slide plates each have an interior surface, an exterior surface, and a slot. The interior surface of each plate is slidable on the exterior surface of an associated one of the side panels. Levers each have a handle, actuator ends, and a central extent. Pivot pins couple the central extents of the levers to the panel. Each actuator end has a slot. A follower pin extends interiorly from a lower end of each slide plate and through an associated slot in an actuator end. A leg support roller is mounted in the plates for raising and lowering the plates in response to pivoting of the levers.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved muscle group isolator system which has all of the advantages of the prior art exercise systems of known designs and configurations and none of the disadvantages.

It is another object of the present invention to provide a new and improved muscle group isolator system which may be easily and efficiently manufactured and marketed.

It is further object of the present invention to provide a new and improved muscle group isolator system which is of durable and reliable constructions.

An even further object of the present invention is to provide a new and improved muscle group isolator system which is susceptible of a low cost of manufacture with regard to both materials and labor, and which accordingly is then susceptible of low prices of sale to the consuming public, thereby making such muscle group isolator system economically available to the buying public.

Lastly, it is an object of the present invention to provide a new and improved muscle group isolator system for facilitating the performance of therapeutic exercises by way of muscle isolation and prevention of associated joint movement and elimination of body compensation, the performance, isolation, prevention and elimination being done in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a muscle group isolator system constructed in accordance with the principles of the present invention.

FIG. 2 is a front elevational view taken along line 2-2 of FIG. 1.

The same reference numerals refer to the same parts throughout the various Figures.

DESCRIPTION OF THE PREFERRED EMBODIMENT

Figure 3:
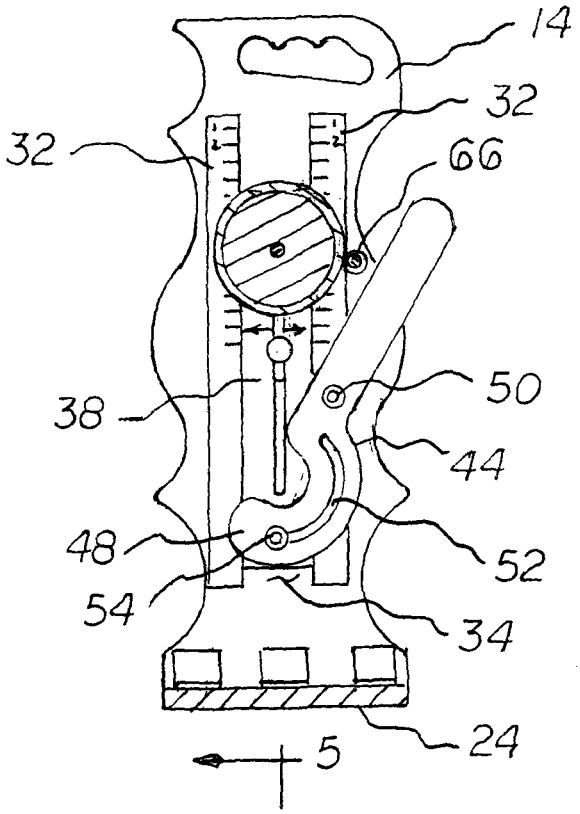
FIG. 3 is a cross sectional view taken along line 3-3 of FIG. 2 showing the support cylinder in the raised orientation.
Figure 4:
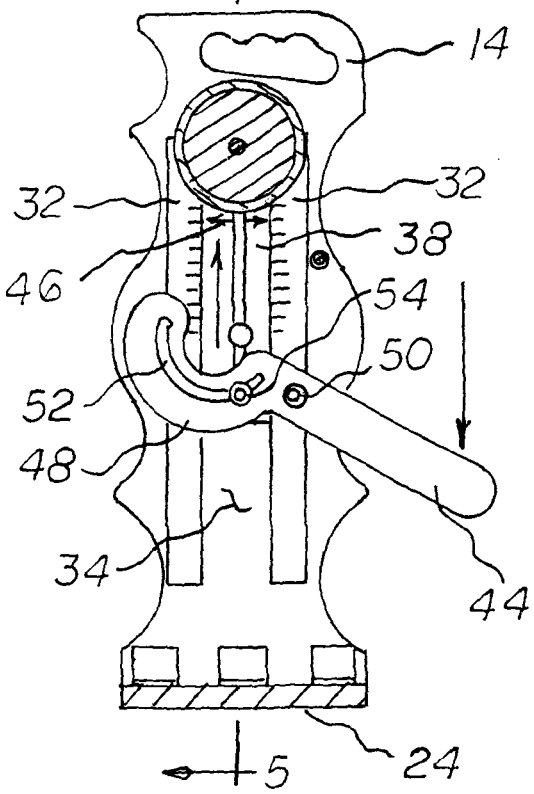
FIG. 4 is a view similar to FIG. 3 but showing the support cylinder in a lowered orientation.
Figure 5:
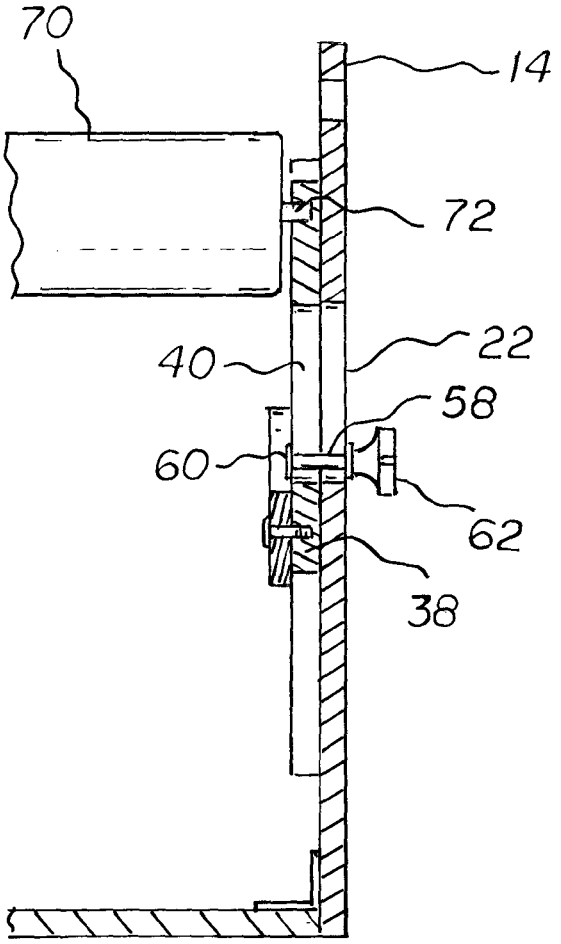
FIG. 5 is a cross sectional view taken along line 5-5 of FIG. 4.
Figure 6:
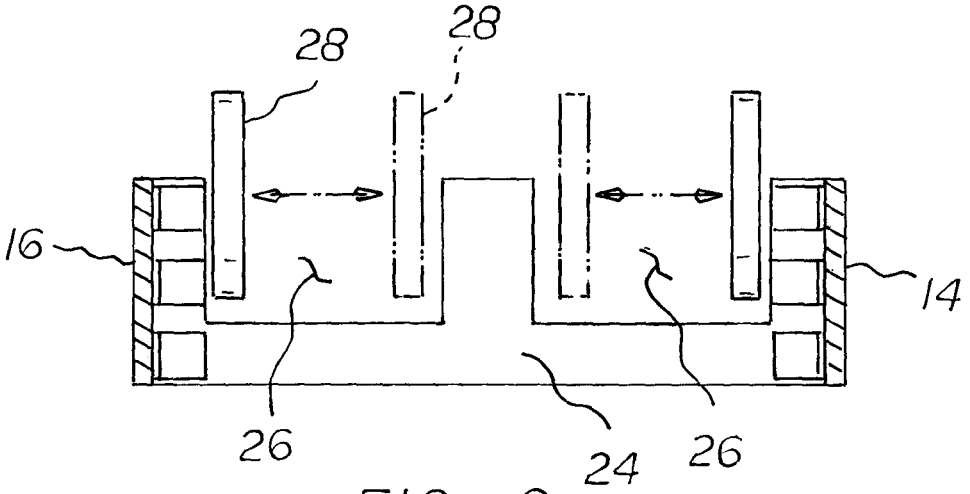
FIG. 6 is a cross sectional views taken along line 6-6 of FIG. 2.

With reference now to the drawings, and in particular to FIG. 1 thereof, the preferred embodiment of the new and improved muscle group isolator system embodying the principles and concepts of the present invention and generally designated by the reference numeral 10 will be described.

The present invention, the muscle group isolator system 10 is comprised of a plurality of components. Such components in their broadest context include laterally spaced side panels, slide plates, levers, and a leg. Such components are individually configured and correlated with respect to each other so as to attain the desired objective.

First provided is a left side panel 14. A similarly configured right side panel 16 is also provided. Each side panel has a forward edge 18. Each side panel has a rearward edge 20. Each side panel is vertically oriented. Each side panel is laterally spaced from each other. In this manner a chamber is formed between the side panels. Each side panel has an interior surface. Each side panel has an exterior surface. Each side panel has an upper end. Each side panel has a lower end. Each side panel has a central extent. The central extent is pro vided between the upper end and the lower end. Each side panel has a handling opening. The handling opening is provided adjacent to the upper end. Each side panel has an exterior slot 22. A horizontally oriented bottom panel 24 is provided. The bottom panel couples the lower ends of the side panels. The bottom panel has recessed spaces 26. Wheels 28 are provided. The recessed spaces are adapted to receive the various sizes of wheels of wheelchairs.

A pair of rectilinear boards 32 is provided for each side panel. The boards have exterior surfaces. The exterior surfaces of the boards are secured to the interior surfaces of the associated panels. The boards of each panel are vertically oriented. The boards of each panel hare spaced from each other. In this manner left and right channels 34 are formed. The boards of each panel have upper ends. The boards of each panel have lower ends. The boards of each panel have central extents. The central extents are provided between the upper ends and the lower ends. The boards have interior surfaces. The interior surfaces have measuring indicia marked thereon. In this manner the indicia may be viewed by the user and a care provider.

A pair of similarly configured rectilinear slide plates 38 is provided. Each slide plate has an upper end. Each slide plate has a lower end. Each slide plate has a central extent. The central extent is provided between the upper end and the lower end. Each slide plate has an interior surface. Each slide plate has an exterior surface. The interior surface of each slide plate is slidable on the exterior surface of an associated side panel. Each slide plate is located between associated boards. Each slide plate is slidable between an upper orientation and a lower orientation. Each slide plate has a vertical interior slot 40. The slot overlies an associated exterior slot. Height indicator indicia is provided on the exterior surface of each slide plate 46.

A pair of similarly configured levers 44 is also provided. Each lever has a handle end 42. Each lever has an actuator end 48. Each lever has a central extent. The central extent is provided between the handle end and the actuator end. Pivot pins 50 are provided. The pivot pins couple the central extents of the levers to central extents of associated boards forwardly of the slots. Each actuator end has an arcuate slot 52. A follower pin 54 is provided. The follower pin extends interiorly from the lower end of each slide plate. The flower pin further extends through an associated slot. In this manner rotation of handle end moves the slot. Further in this manner the flower pin and the slide plate are raised and lowered.

A pair of similarly configured locking bolts 58 is provided next. Each locking bolt extends through associated interior and exterior slots. Each locking bolt has a head 60. The head is provided interiorly. The head is provided in contact with an associated slide plate. Each locking bolt has a nut 62. The nut is provided exteriorly. The nut is provided in contact with an associated side panel. The bolts are adapted to be loosened when moving the lever and slide plate. The bolts are adapted to be tightened for operation and use.

Further provided is a strengthening bar 66. The strengthening bar is adapted to provide rigidity to the system. The strengthening bar is secured to and spans the slide plates forwardly of the boards and above the pivot pins.

Provided last is a leg supporting roller 70. The roller has a rigid cylindrical core. The roller has a padded periphery. End stubs 72 are provided. The roller is axially supported for rotation on the end stubs. The end stubs are mounted in the upper ends of the slide plates. In this manner the slide plate is raised and lowered in response to the movement of the levers.

The present invention is an adjustable muscle group isolator system, a system for use by a person in a portable wheelchair or up-right-chair or reclined position. It functions to improve rehabilitation of some brain and spinal cord injuries including, but limited to:

BILATERAL LOWER EXTREMITIES DYSFUNCTIONS;

PELVIS: Injuries/Fractures/Operations;

HIP: Injuries/Fractures/Operations;

KNEE: Injuries/Fractures/Operations, and

ANKLE: Injuries/Fractures/Operations.

By way of muscle group isolation, the invention functions in the prevention of associated joint movement and elimination of body compensation through therapeutic exercises.

This invention facilitates muscle re-education, increasing performance of therapeutic exercises which increases range of motion. It also increases muscle strength and promotes healing correctly which improves functionality and speedy recovery.

The muscle group isolator is designed for upright or reclined position and wheelchair seated patients, which makes performance of therapeutic exercises scientifically easy as follows:

Hip—External and internal rotation;

Hip—Abduction and abduction;

Knee—Extension and flexion;

Ankle—Plantar flexion;

Ankle—Dorsi flexion;

Ankle—Inversion and

Ankle—Eversion.

Flexion of metacarpophalangeal joints of hallux, in accordance with the resent invention, ultimately leads to improvement of rehabilitation diagnosis as well as improvement of a patient's function and activities of daily living.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A muscle group isolator system comprising:

laterally spaced side panels, each side panel having an interior surface and an exterior surface and a slot;

slide plates each having an interior surface and an exterior surface, the interior surface of each slide plate being slidable on the exterior surface of an associated one of the side panels, each slide plate having a slot;

levers each having a handle configured to be grasped by a user and an actuator end and a central extent there between, pivot pins each coupling the central extent of one of the levers to an associated one of the side panels, each actuator end having a slot, follower pins each extending interiorly from a lower end of one of the slide plates and through an associated slot in one of the actuator ends; and a leg supporting roller mounted in the side plates for raising and lowering with the plates in response to pivoting of the levers.

2. The system as set forth in claim 1 wherein the slots in the plates are linear and vertically oriented and wherein the slots in the lever are arcuate.

3. The system as set forth in claim 1 and further including:

two pair of rectilinear boards, one pair of boards for each side panel, each board having an exterior surface secured to the interior surface of an associated one of the side panels, each board having an interior surface, the boards being vertically oriented and spaced from each other to form a left channel and a right channel, each board having an upper end and a lower end and a central extent there between.

4. The system as set forth in claim 3 wherein the interior surface of each board has measuring indicia marked thereon for viewing by a user and a care provider.

5. A muscle group isolator system for facilitating the performance of therapeutic exercises by way of muscle isolation and prevention of associated joint movement and elimination of body compensation, the performance, isolation, prevention and elimination being done in a safe, convenient and economical manner, the system comprising, in combination:

a left side panel and a similarly configured right side panel, each side panel having a forward edge and a rearward edge, the side panels being vertically oriented and laterally spaced from each other to form a chamber there between, each side panel having an interior surface and an exterior surface, each side panel having an upper end and a lower end and a central extent there between, a handling opening in each side panel adjacent to the upper end, each side panel having an exterior slot, a horizontally oriented bottom panel coupling the lower ends of the side panels, the bottom panel having recessed spaces, the recessed spaces adapted to receive the various sizes of wheels of wheelchairs;

a pair of rectilinear boards for each side panel, the boards of each panel having exterior surfaces secured to the interior surface of the associated one of the side panels, the boards of each panel being vertically oriented and spaced from each other to form right and left channels, the boards of each panel having upper ends and lower ends and central extents there between, the boards having interior surfaces with measuring indicia marked thereon for viewing by a user and a care provider;

a pair of similarly configured rectilinear slide plates, each slide plate having an upper end and a lower end and a central extent there between, each slide plate having an interior surface and an exterior surface, the interior surface of each slide plate being slidable on the exterior surface of an associated side panel, each slide plate located between associated boards and slidable between an upper orientation and a lower orientation, each slide plate having a vertical interior slot overlying an associated exterior slot, height indicator indicia on the exterior surface of each slide plate;

a pair of similarly configured levers, each lever having a handle end and an actuator end and a central extent there between, pivot pins coupling the central extents of the levers to central extents of associated boards forwardly of the slots, each actuator end having an arcuate slot, a follower pin extending interiorly from the lower end of each slide plate and through an associated slot whereby rotation of handle end will move the slot to raise and lower the follower pin and the slide plate;

a pair of similarly configured locking bolts, each locking bolt extending through associated interior and exterior slots, each locking bolt having a head interiorly in contact with an associated slide plate, each locking bolt having a nut exteriorly in contact with an associated side panel, the bolts adapted to be loosened when moving the lever and slide plate, the bolts adapted to be tightened for operation and use; a strengthening bar adapted to provide rigidity to the system, the strengthening bar secured to and spanning the slide plates forwardly of the boards and above the pivot pins; and a leg supporting roller, the roller having a rigid cylindrical core with a padded periphery, the roller being axially supported for rotation on end stubs, the end stubs being mounted in the upper ends of the slide plates for raising and lowering with the raising and lowering of the slide plates in response to the movement of the levers.

* * * * *